US006524077B2

(12) United States Patent
Suitou et al.

(10) Patent No.: US 6,524,077 B2
(45) Date of Patent: Feb. 25, 2003

(54) CONTROL VALVE FOR VARIABLE DISPLACEMENT COMPRESSOR

(75) Inventors: Ken Suitou, Kariya (JP); Kazuya Kimura, Kariya (JP); Masahiro Kawaguchi, Kariya (JP); Masaki Ota, Kariya (JP); Satoshi Umemura, Kariya (JP); Tomoji Tarutani, Kariya (JP); Norio Uemura, Fujisawa (JP); Kouji Watanabe, Fujisawa (JP); Hideki Higashidouzono, Fujisawa (JP); Syuji Hukunaga, Fujisawa (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 77 days.

(21) Appl. No.: 09/851,706

(22) Filed: May 9, 2001

(65) Prior Publication Data

US 2002/0004011 A1 Jan. 10, 2002

(30) Foreign Application Priority Data

May 10, 2000 (JP) ..... 2000-137631

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3; 137/251; 91/504–506

(56) References Cited

U.S. PATENT DOCUMENTS 6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al. ..... 417/222.2

FOREIGN PATENT DOCUMENTS

JP 11-324930 11/1999

* cited by examiner

*Primary Examiner*—Charles G. Freay
*Assistant Examiner*—William H. Rodriguez
(74) *Attorney, Agent, or Firm*—Morgan & Finnegan, LLP

(57) ABSTRACT

A control valve used in a variable displacement compressor includes a valve chamber, a valve body and a pressure sensing chamber. A pressure sensing ball is movably located in the pressure sensing chamber and divides the pressure sensing chamber into a first pressure chamber and a second pressure chamber. First and second pressure monitoring points are located in a refrigerant circuit. The first pressure chamber is exposed to the pressure at the first pressure monitoring point. The second pressure chamber is exposed to the pressure at the second pressure monitoring point. The ball is displaced based on the pressure difference between the first pressure chamber and the second pressure chamber. The position of the valve body is determined based on the position of the pressure sensing member.

20 Claims, 7 Drawing Sheets

CONTROL VALVE FOR VARIABLE DISPLACEMENT COMPRESSOR

BACKGROUND OF THE INVENTION

The present invention relates to a variable displacement compressor used in a refrigerant circuit of a vehicle air conditioner. More particularly, the present invention pertains to a control valve that changes the displacement of the compressor based on the pressure in a crank chamber.

Japanese Unexamined Patent Publication No. 11-324930 discloses such a displacement control valve for compressors. As shown in FIG. 7, a valve chamber 101 is defined in a valve housing 105. The valve chamber 101 forms a part of a supply passage 104, which connects a discharge chamber 102 to a crank chamber 103 of a compressor. A valve body 106 is movably located in the valve chamber 101. The opening degree of the supply passage 104 is adjusted in accordance with the position of the valve body 106 in the valve chamber 101. A pressure sensing chamber 107 is defined in the valve housing 105. A pressure sensing member 108, which includes a diaphragm, divides the pressure sensing chamber 107 into a first pressure chamber 109 and a second pressure chamber 110.

Two pressure monitoring points P1, P2 exist in a refrigerant circuit (refrigeration cycle). A first pressure monitoring point P1 is located in a higher pressure zone.

That is, the first pressure monitoring point P1 is exposed to a pressure PdH to which the first pressure chamber 109 is exposed. A second pressure monitoring point P2 is located in a lower pressure zone. That is, the second pressure monitoring point P2 is exposed to a pressure PdL to which the second pressure chamber 110 is exposed. The pressure difference ΔPd (ΔPd=PdH−PdL) between the first pressure chamber 109 and the second pressure chamber 110 represents the flow rate in the refrigerant circuit. Fluctuations of the pressure difference ΔPd, or displacements of the pressure sensing member 108 based on fluctuations of refrigerant flow rate in the refrigeration circuit, affect the position of the valve body 106. Accordingly, the displacement of the compressor is changed to counteract the fluctuations of the refrigerant flow rate.

If the speed of an engine that drives the compressor changes when the compressor displacement is constant, the flow rate of refrigerant in the refrigerant circuit, or the pressure difference ΔPd, is changed. The pressure sensing member 108 changes the pressure displacement such that the changes of the pressure difference ΔPd are cancelled. Accordingly, the refrigerant flow rate in the refrigerant circuit is maintained.

However, the diaphragm used in the pressure sensing member 108 is costly and difficult to machine. Also, since the circumference of the pressure sensing member 108 must be fixed to the valve housing 105 (the inner wall of the pressure sensing chamber 107), the installation of the pressure sensing member 108 is troublesome, which increases the cost of the control valve.

BRIEF SUMMARY OF THE INVENTION

Accordingly, it is an objective of the present invention to provide a control valve used in a variable displacement compressor having an inexpensive pressure sensing member that is easy to install in a valve housing.

To achieve the foregoing and other objectives and in accordance with the purpose of the present invention, a control valve used for a variable displacement compressor in a refrigerant circuit is provided. The compressor changes the displacement in accordance with the pressure in a crank chamber and includes a supply passage, which connects a discharge pressure zone to the crank chamber, and a bleed passage, which connects a suction pressure zone to the crank chamber. The control valve includes a valve housing, a valve chamber, a valve body, a pressure sensing chamber, a spherical pressure sensing member and first and second pressure monitoring points. The valve chamber is defined in the valve housing and is part of the supply passage or the bleed passage. The valve body is located in the valve chamber and changes its position in the valve chamber thereby adjusting the opening size of the supply passage or the bleed passage in the valve chamber. The pressure sensing chamber is defined in the valve housing. The pressure sensing member is movably located in the pressure sensing chamber and divides the pressure sensing chamber into a first pressure chamber and a second pressure chamber. The first and second pressure monitoring points are located in the refrigerant circuit. The first pressure chamber is exposed to the pressure at the first pressure monitoring point. The second pressure chamber is exposed to the pressure at the second pressure monitoring point. The pressure sensing member moves in accordance with the pressure difference between the first pressure chamber and the second pressure chamber. The position of the valve body is determined based on the position of the pressure sensing member.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve according to one embodiment of the present invention will now be described with reference to FIGS. 1 to 6. The control valve forms a part of refrigerant circuit in a vehicle air conditioner.

Figure 1:
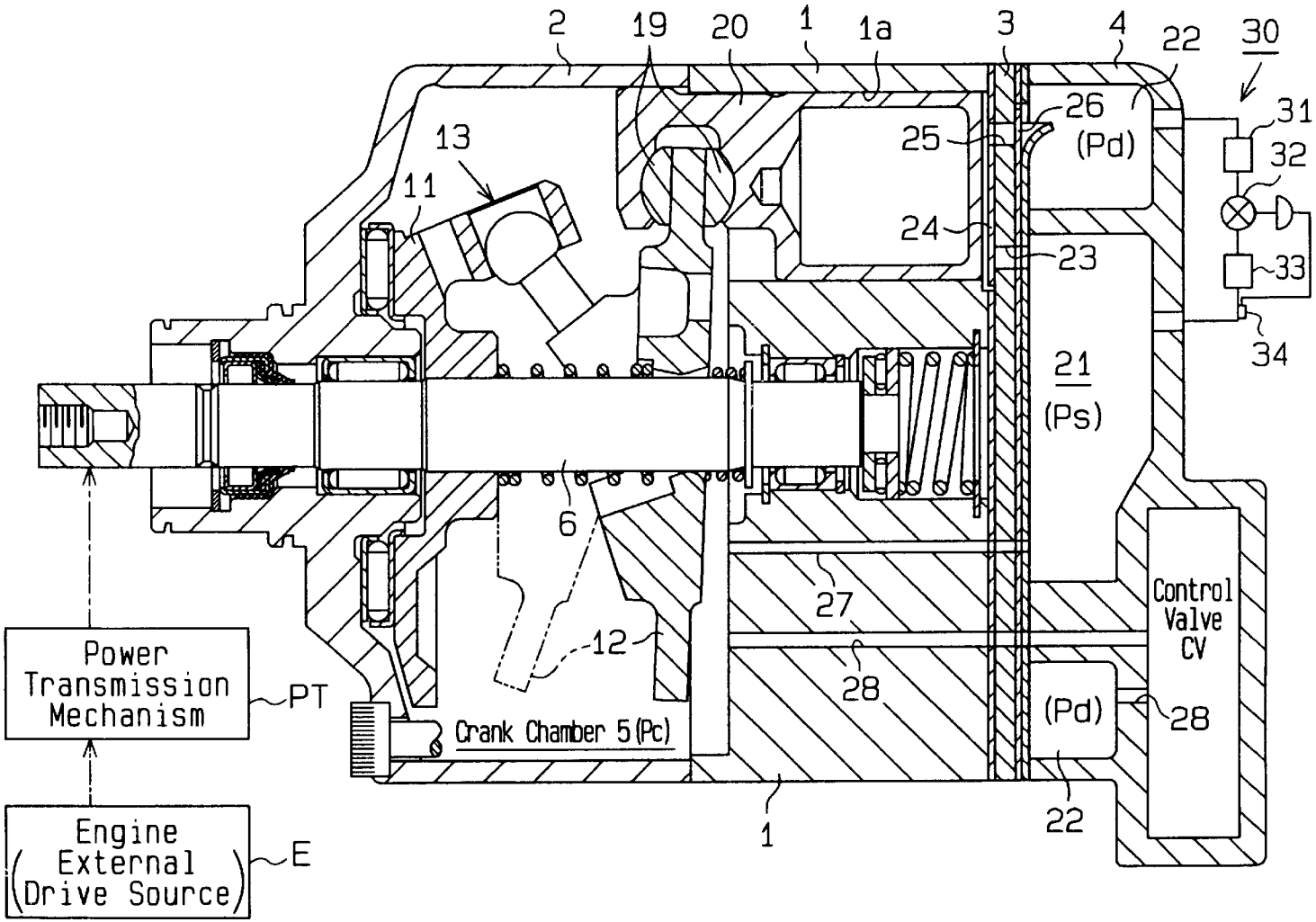
FIG. 1 is a cross-sectional view illustrating a swash plate type variable displacement compressor according to one embodiment of the present invention.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1.

A crank chamber 5 is defined between the cylinder block 1 and the front housing member 2. A drive shaft 6 is supported in the crank chamber 5 by bearings. A lug plate 11 is fixed to the drive shaft 6 in the crank chamber 5 to rotate integrally with the drive shaft 6.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores la (only one is shown in FIG. 1) at constant angular intervals around the drive shaft 6. Each cylinder bore la accommodates a single headed piston 20 such that the piston 20 can reciprocate in the bore la. A compression chamber, the displacement of which varies in accordance with the reciprocation of the piston 20, is defined in each bore 1*a*. The front end of each piston 20 is connected to the periphery of the swash plate 12 through a pair of shoes 19. The rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore la, a suction port 23, a suction valve flap 24 for opening and closing the suction port 23, a discharge port 25, and a discharge valve flap 26 for opening and closing the discharge port 25. The suction chamber 21 communicates with each cylinder bore la through the corresponding suction port 23, and each cylinder bore 1*a* communicates with the discharge chamber 22 through the corresponding discharge port 25.

When each piston 20 moves from its top dead center position to its bottom dead center position, the refrigerant gas in the suction chamber 21 flows into the cylinder bore la through the corresponding suction port 23 and the corresponding suction valve flap 24. When the piston 20 moves from its bottom dead center position toward its top dead center position, the refrigerant gas in the cylinder bore la is compressed to a predetermined pressure, and it forces the corresponding discharge valve flap 26 to open. The refrigerant gas is then discharged through the corresponding discharge port 25 and the corresponding discharge valve flap 26 into the discharge chamber 22.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the pistons 20, and a moment due to the gas pressure. The moment due to the gas pressure is based on the relationship between the pressure in the cylinder bores 1*a* and the crank pressure Pc. The moment due to the gas pressure increases or decreases the inclination angle of the swash plate 12 in accordance with the crank pressure Pc.

In this embodiment, the moment due to the gas pressure is changed by controlling the crank pressure Pc with a displacement control valve CV. The inclination angle of the swash plate 12 can be changed to an arbitrary angle between the minimum inclination angle (shown by a solid line in FIG. 1) and the maximum inclination angle (shown by a broken line in FIG. 1).

Figure 2:
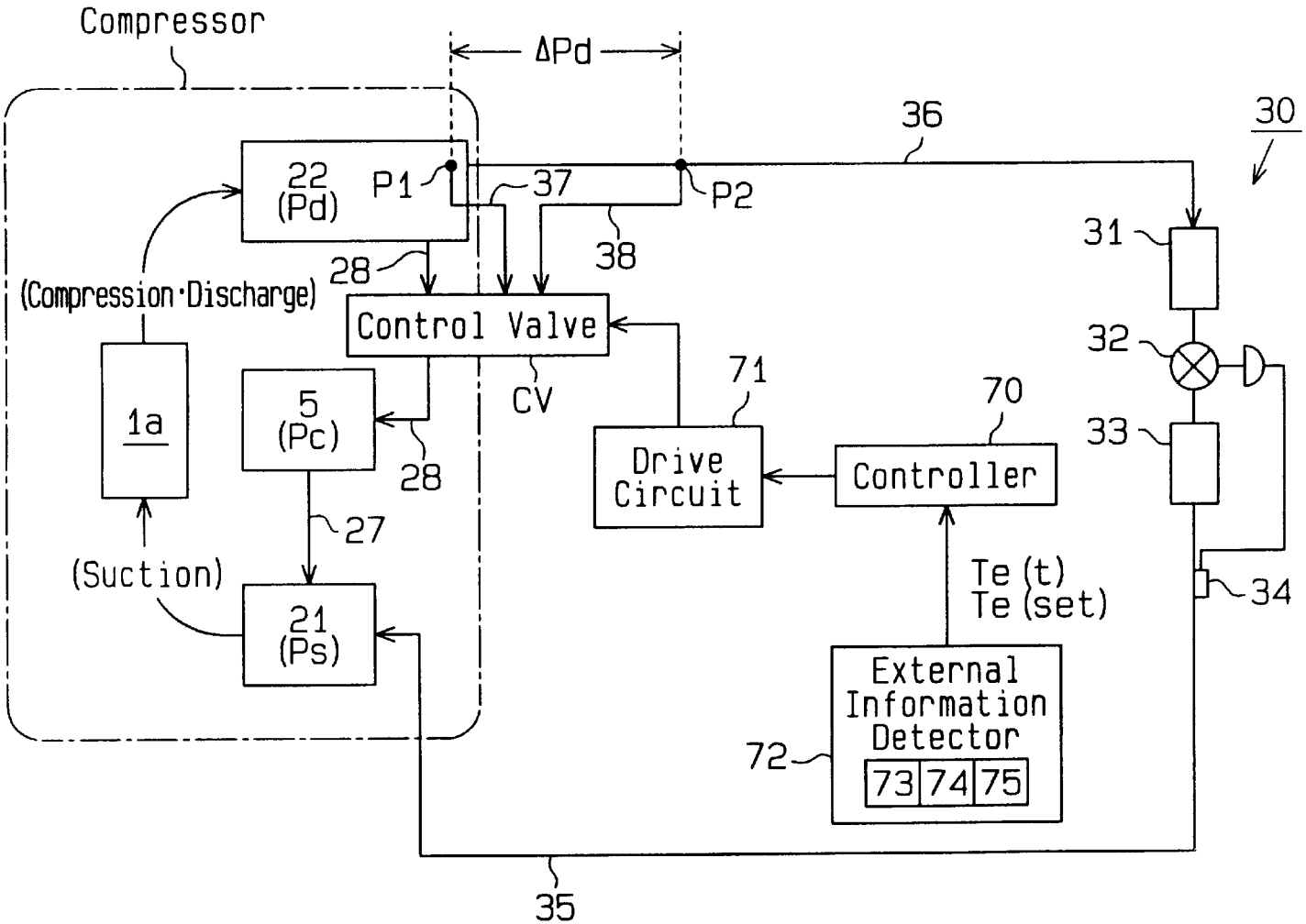
FIG. 2 is a circuit diagram schematically showing a refrigerant circuit.

As shown in FIGS. 1 and 2, a control mechanism for controlling the crank pressure Pc includes a bleed passage 27, a supply passage 28 and a displacement control valve CV. The bleed passage 27 connects the suction chamber 21, which is exposed to suction pressure (Ps), and the crank chamber 5. The supply passage 28 connects the discharge chamber 22, which is exposed to discharge pressure (Pd), and the crank chamber 5. The displacement control valve CV is provided midway along the supply passage 28.

The displacement control valve CV changes the opening size of the supply passage 28 to control the flow rate of refrigerant gas flowing from the discharge chamber 22 to the crank chamber 5. The pressure in the crank chamber 5 is changed in accordance with the relation between the flow rate of refrigerant gas flowing from the discharge chamber 22 into the crank chamber 5 and the flow rate of refrigerant gas flowing out from the crank chamber 5 through the bleed passage 27 into the suction chamber 21. In accordance with changes in the crank pressure Pc, the difference between the crank pressure Pc and the pressure in the cylinder bores 1*a* varies to change the inclination angle of the swash plate 12. As a result, the stroke of the pistons 20 is changed to control the discharge displacement.

As shown in FIGS. 1 and 2, the refrigerant circuit of the vehicle air conditioner includes the compressor and an external refrigerant circuit 30. The external refrigerant circuit 30 includes, for example, a condenser 31, an expansion valve 32, and an evaporator 33. The opening of the expansion valve 32 is feedback-controlled on the basis of the temperature detected by a temperature sensing tube 34 provided near the outlet of the evaporator 33. The expansion valve 32 supplies a quantity of refrigerant corresponding to the thermal load to control the flow rate.

In the downstream part of the external refrigerant circuit 30, a flow pipe 35 is provided to connect the outlet of the evaporator 33 with the suction chamber 21. In the upstream part of the external refrigerant circuit 30, a flow pipe 36 is provided to connect the discharge chamber 22 of the compressor with the inlet of the condenser 31. The compressor draws refrigerant gas from the downstream side of the external refrigerant circuit 30, compresses the gas, and then discharges the compressed gas to the upstream side of the external refrigerant circuit 30.

The larger the displacement of the compressor is and the higher the flow rate of the refrigerant flowing in the external refrigerant circuit 30 is, the greater the pressure loss per unit length of the circuit, or piping, is. More specifically, the pressure loss between two points in the external refrigerant circuit 30 correlates with the flow rate of the external refrigerant circuit 30. In this embodiment, detecting the difference in pressure $\Delta P(t)=PdH-PdL$ between two pressure monitoring points P1 and P2 indirectly detects the discharge displacement of the compressor. An increase in the discharge displacement of the compressor increases the flow rate of the refrigerant in the refrigerant circuit, and a decrease in the discharge displacement of the compressor decreases the flow rate of the refrigerant. Thus, the flow rate of the refrigerant in the external refrigerant circuit 30, i.e., the pressure difference ΔPd between the two points, reflects the discharge displacement of the compressor.

In this embodiment, an upstream, or first, pressure monitoring point P1 is located in the discharge chamber 22, and a downstream, or second, pressure monitoring point P2 is set midway along the flow pipe 36 at a position separated from the first pressure monitoring point P1 by a predetermined distance. The gas pressure PdH at the first pressure monitoring point P1 and the gas pressure PdL at the second pressure monitoring point P2 are applied respectively through first and second pressure detecting passages 37 and 38 to the displacement control valve CV.

Figure 3:
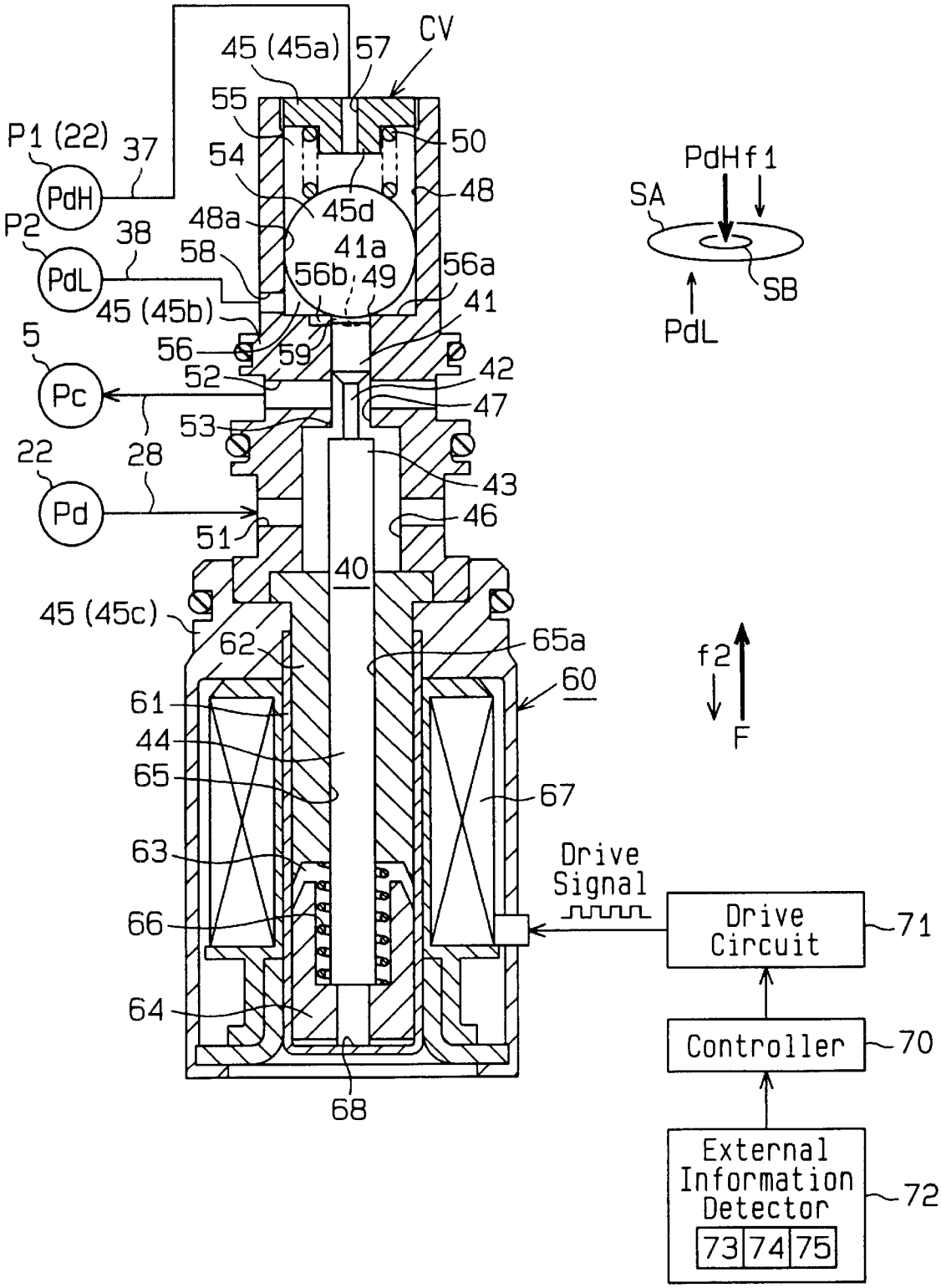
FIG. 3 is a sectional view of a control valve provided in the compressor of FIG. 1.

As shown in FIG. 3, the control valve CV has an inlet valve portion and a solenoid 60. The inlet valve portion controls the opening of the supply passage 28, which connects the discharge chamber 22 with the crank chamber 5. The solenoid 60 serves as an electromagnetic actuator for controlling a rod 40 located in the control valve CV on the basis of an externally supplied electric current. The rod 40 has a distal end portion 41, a valve body 43, a connecting portion 42, which connects the distal end portion 41 and the valve body 43 with each other, and a guide 44. The valve body 43 is part of the guide 44.

A valve housing 45 of the control valve CV has a plug 45*a*, an upper half body 45*b* and a lower half body 45*c*. The upper half portion 45*b* defines the shape of the inlet valve portion. The lower half body 45*c* defines the shape of the solenoid 60. A valve chamber 46 and a communication passage 47 are defined in the upper half body 45*b*. The upper half body 45*b* and the plug 45*a* define a pressure sensing chamber 48. The pressure sensing chamber 48 includes an annular inner surface 48*a*.

The rod 40 moves in the axial direction of the control valve CV in the valve chamber 46. The rod 40 extends through the communication passage 47 and the pressure sensing chamber 48. The valve chamber 46 is selectively connected to and disconnected from the passage 47 in accordance with the position of the rod 40. The communication passage 47 is separated from the pressure sensing chamber 48 by the distal end portion 41 of the rod 40.

The bottom wall of the valve chamber 46 is formed by the upper end surface of a fixed iron core 62. A first radial port 51 allows the valve chamber 46 to communicate with the discharge chamber 22 through an upstream part of the supply passage 28. A second radial port 52 allows the communication passage 47 to communicate with the crank chamber 5 through a downstream part of the supply passage 28. Thus, the first port 51, the valve chamber 46, the communication passage 47, and the second port 52 form a part of the supply passage 28, which communicates the discharge chamber 22 with the crank chamber 5.

The valve body 43 of the rod 40 is located in the valve chamber 46. The inner diameter of the communication passage 47 is larger than the diameter of the connecting portion 42 of the rod 40 and is smaller than the diameter of the guide 44. That is, the opening area SB of the communication passage 47 (the cross sectional area of the distal end portion 41) is larger than the cross sectional area of the connecting portion 42 and smaller than the cross sectional area of the guide 44. A valve seat 53 is formed at the opening of the communication passage 47 (around the valve hole).

Figure 4C:
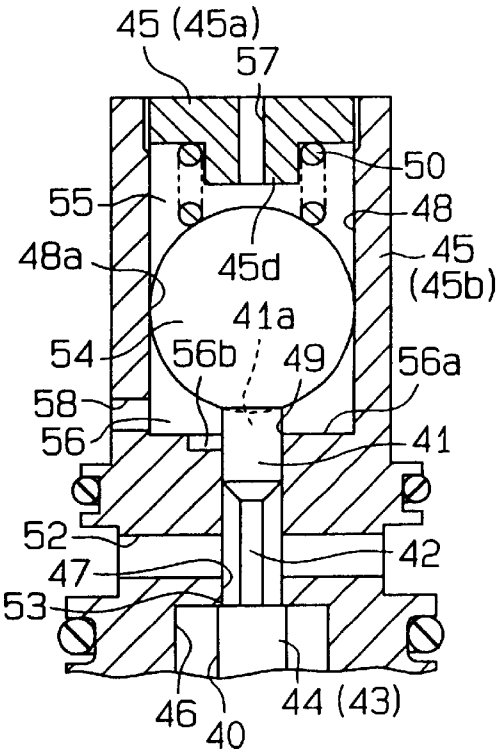
FIGS. 4(*a*), 4(*b*) and 4(*c*) are enlarged partial cross-sectional views showing operation of the control valve.
Figure 4B:
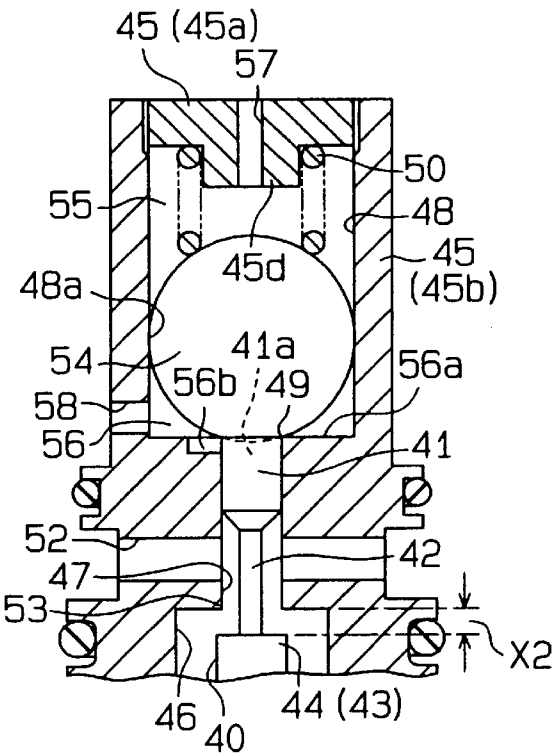
Figure 4A:
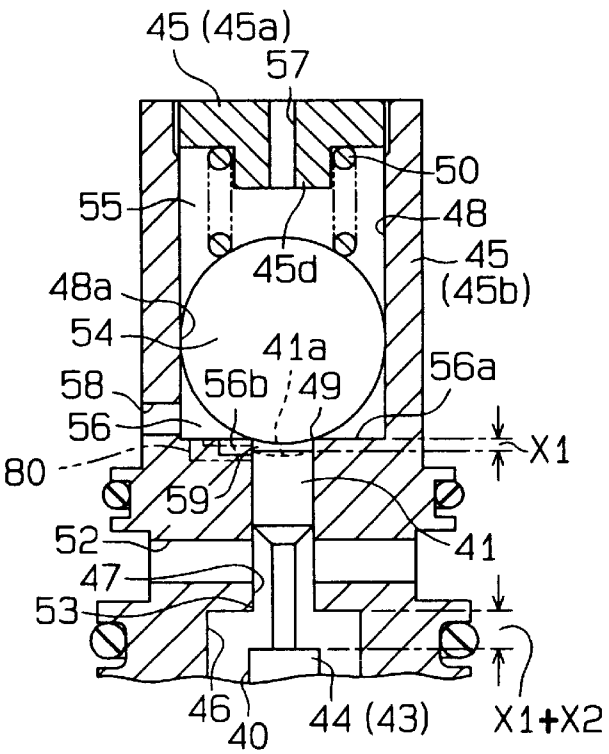

When the rod 40 moves from the lowest position shown in FIGS. 3 and 4(*a*) to the highest position shown in FIG. 4(*c*), at which the valve body 43 contacts the valve seat 53, the communication passage 47 is closed. Thus, the valve body 43 of the rod 40 serves as an inlet valve body that controls the opening of the supply passage 28.

A pressure sensing member, which is a ball 54 in this embodiment, is located in the pressure sensing chamber 48. The ball 54 is made of, for example, steel or resin and moves in the axial direction. If made of steel, the ball 54 is highly durable. If made of resin, the ball 54 is light.

The ball 54 contacts the inner surface 48*a* of the pressure sensing chamber 48 and the area of contact between the ball 54 and the inner surface 48*a* of the pressure sensing chamber 48. The ball 54 axially divides the pressure sensing chamber into a first pressure chamber 55 and a second pressure chamber 56. The pressure sending member wall 54 does not permit fluid to move between the first pressure chamber 55 and the second pressure chamber 56. The cross-sectional area SA of the ball 54 is greater than the cross-sectional area SB of the communication passage 47.

The movement of the ball 54 into the second pressure chamber 56, or toward the valve chamber 46, is limited by contact between the ball 54 with the bottom 56*a* of the second pressure chamber 56, or by contact between the ball 54 with the open end of the communication passage 47 defined in the bottom 56*a*. That is, the open end of the passage 47 defines a first regulator, which is a first regulation surface 49 in this embodiment, for the ball 54. When contacting the first regulation surface 49, the ball 54 covers the upper opening of the communication passage 47, which opens to the pressure sensing chamber 48 (the second pressure chamber 56).

Communicating means, which is a releasing groove 56*b* in this embodiment, is formed in the bottom 56*a* of the second pressure chamber 56 by cutting away part of the first regulation surface 49, or the open end of the communication passage 47. Thus, when the ball 54 contacts the first regulation surface 49, the recess communicates the communication passage 47 with the second pressure chamber 56.

A first urging member, which is a coil spring 50 in this embodiment, is accommodated in the first pressure chamber 55. The spring 50 urges the ball 54 from the first pressure chamber 55 to the second pressure chamber 56, or toward the first regulation surface 49. A cylindrical spring seat 45d projects from the lower face of the plug 45*a*, which is located in the first pressure chamber 55. The spring 50 is fitted to the spring seat 45*d*, which stabilizes the orientation of the spring 50 toward the ball 54. The set load of the spring 50, which will be discussed below, may be adjusted by changing the threaded amount of the plug 45*a* into the upper portion 45*b*, or by changing the projecting amount of the plug 45*a* into the first pressure chamber 55.

The first pressure chamber 55 is communicated with the discharge chamber 22 through a first port 57, which is formed in the plug 45*a* and a first pressure introduction passage 37. The first pressure monitoring point P1 is located in the discharge chamber 22. The second pressure chamber 56 is communicated with the second pressure monitoring point P2 through a second port 58, which is formed in the upper portion 45*b* of the valve housing 45, and a second pressure introduction passage 38. That is, the first pressure chamber 55 is exposed to the discharge pressure PdH, and the second pressure chamber 56 is exposed to the pressure PdL at the second pressure monitoring point P2.

The solenoid 60 includes a cup-shaped cylinder 61. A fixed iron core 62 is fitted in the upper part of the cylinder 61. A solenoid chamber 63 is defined in the cylinder 61. A movable iron core 64 is accommodated to move axially in the solenoid chamber 63. An axially extending guide hole 65 is formed in the central portion of the fixed iron core 62. The guide 44 of the rod 40 is located to move axially in the guide hole 65.

The proximal end of the rod 40 is accommodated in the solenoid chamber 63. More specifically, the lower end of the guide 44 is fitted in a hole formed at the center of the movable iron core 64 and fixed by crimping. Thus, the movable iron core 64 and the rod 40 move integrally and axially.

The lower end portion of the guide 44 projects downward from the lower surface of the movable iron core 64. The downward movement of the rod 40 (the valve body 43) is stopped when the lower end surface of the guide 44 contacts the bottom surface of the solenoid chamber 63. That is, the bottom surface of the solenoid chamber 63 serves as a second regulator, which is a second regulation surface 68 in this embodiment. The second regulation surface 68 prevents the rod 40 (the valve body 43) from moving downward to limit the opening of the communication passage 47.

A second urging member, which is a second spring 66 in this embodiment, is accommodated between the fixed and movable iron cores 62 and 64 in the solenoid chamber 63. The second spring 66 urges the movable iron core 64 away from the fixed iron core 62. The second spring 66 urges the rod 40 (the valve body 43) downward, i.e., toward the second regulation surface 68.

As shown in FIGS. 3 and 4(*a*), when the rod 40 is at its lowest position, at which the rod 40 contacts the second regulation surface 68, the valve body 43 is separated from the valve seat 53 by distance X1+X2, and the opening of the communication passage 47 is maximized. In this state, the distal end portion 41 of the rod 40 sinks into the communication passage 47 by distance X1 relative to the pressure sensing chamber 48.

Accordingly, the distal end surface 41*a* of the distal end portion 41 is separated from the ball 54, which contacts the first regulation surface 49 by distance X1, and a space 59 is defined by the surface of the ball 54 and the distal end surface 41*a* in the communication passage 47. However, since the groove 56*b* is formed in the regulation surface 49, the space 59 completely separated from the second pressure chamber 56.

A coil 67 is wound about the stationary core 62 and the movable core 64. The coil 67 receives drive signals from a drive circuit 71 based on commands from a controller 70. The coil 67 generates an electromagnetic force F that corresponds to the value of the current from the drive circuit 71. The electromagnetic force F urges the movable core 64 toward the stationary core 62. The electric current supplied to the coil 67 is controlled by controlling the voltage applied to the coil 67. This embodiment employs duty control for controlling the applied voltage.

The position of the rod 40 in the control valve CV, i.e., the valve opening of the control valve CV, is determined as follows. In the following description, the influence of the pressure of the valve chamber 46, the communication passage 47, and the solenoid chamber 63 on the position of the rod 40 will not be taken into account.

As shown in FIGS. 3 and 4(*a*), when no current is supplied to the coil 67 (Dt=0%), the downward force f2 of the second spring 66 is dominant. As a result, the rod 40 is moved to its lowermost position and the force f2 of the second spring 66 presses the rod 40 against the second regulation surface 68. The force f2 by the second spring 66 at this time is the force f2' such that, for example, even when the compressor (the control valve CV) is vibrated by vibration of the vehicle, the rod 40 and the movable iron core 64 are pressed against the second regulation surface 68 and thus resist vibration.

In this state, the valve body 43 is separated from the valve seat 53 by distance X1+X2. As a result, the communication passage 47 is fully open. Thus, the crank pressure Pc is maximized, and the difference between the crank pressure Pc and the pressure in the cylinder bore 1*a* is relatively high. As a result, the inclination angle of the swash plate 12 is minimized, and the discharge displacement of the compressor is also minimized.

When the rod 40 is at its lowermost position, the rod 40 (the distal end portion 41) is disengaged from the ball 54. Thus, for positioning of the ball 54, the total load of the downward force (PdH·SA−PdL(SA−SB)) based on the pressure difference ΔPd between the two points and the downward force f1 of the first spring 50 is dominant. Thus the ball 54 is pressed against the first regulation surface 49 by the total load. At this time, the force f1 by the first spring 50 is f1' such that, e.g., even when the compressor (the control valve CV) is vibrated by vibration of the vehicle, the ball 54 is pressed against the first regulation surface 49 to resist vibration.

In the state shown in FIGS. 3 and 4(*a*), when the electric current corresponding to the minimum duty ratio Dt(min) (Dt(min)>0) within the range of duty ratios is supplied to the coil 67, the upward electromagnetic force F exceeds the downward force f2 (f2=f2') of the second spring 66, and the rod 40 moves upward.

Figure 5:
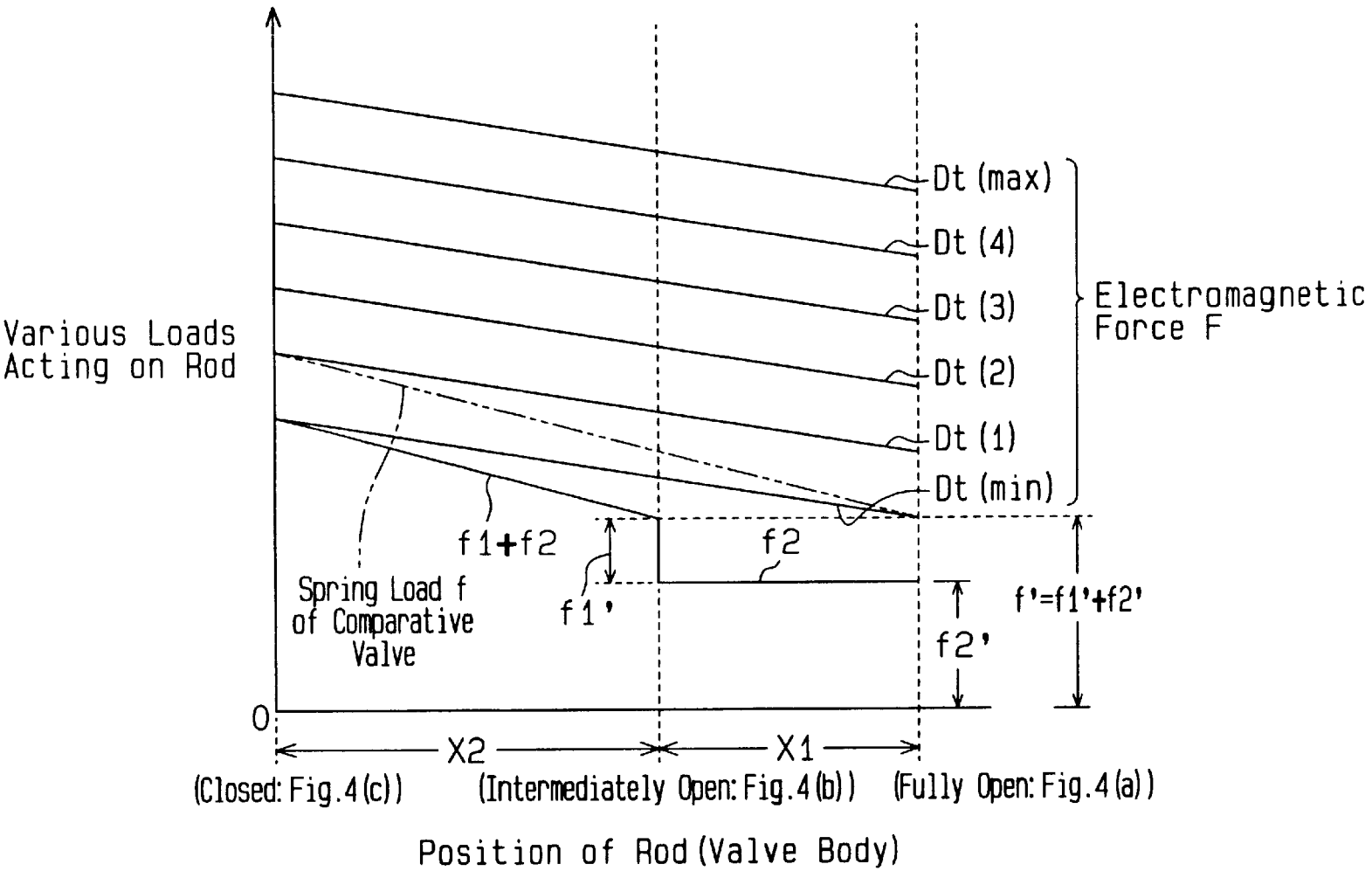
FIG. 5 is a graph showing relationships between the position of the operating rod and various loads acting on the rod.

The graph of FIG. 5 shows relationships between the position of the rod 40 (valve body 43) and various loads acting on the rod 40. When the duty ratio Dt of the electric current supplied to the coil 67 is increased, the electromagnetic force F acting on the rod 40 is increased accordingly. When the rod 40 moves upward to close the valve, since the movable iron core 64 is near to the fixed iron core 62, the electromagnetic force F acting on the rod 40 is increased even if the duty ratio Dt is not changed.

The duty ratio Dt of electric current supplied to the coil 67 is continuously variable between the minimum duty ratio Dt(min) and the maximum duty ration Dt(max) (e.g., 100%) within the range of duty ratios. For ease of understanding, the graph of FIG. 5 only shows cases of Dt(min), Dt(l) to Dt(4), and Dt(max).

As apparent from the inclinations of the characteristic lines f1+f2 and f2, the spring constant of the second spring 66 is significantly smaller than that of the first spring 50. The spring constant of the second spring 66 is relatively low such that the force f2 acting on the rod 40 is substantially the same as the load f2' regardless degree to which the second spring 66 is compressed.

When an electric current that is more than the minimum duty ratio Dt(min) is supplied to the coil 67, the rod 40 moves upward from the lowest position by at least distance X1. As a result, the distal end surface 41*a* of the distal end portion 41 reduces the volume of the space 59, and the distal end surface 41*a* contacts the ball 54. The distal end surface 41*a* is concave to match the surface of the ball 54. The distal end surface 41*a* therefore contacts the ball 54 at a relatively large area. Thus, the ball 54 stably contacts the distal end surface 41*a*.

When the rod 40 contacts the ball 54, the upward electromagnetic force F, which is connected by the downward force f2 of the second spring 66, is opposed to the downward force based on the pressure difference ΔPd between the two points, which adds to the downward urging force f1 of the first spring 50. Thus the valve body 43 of the rod 40 is positioned relative to the valve seat 53 between the state shown in FIG. 4(*b*) and the state shown in FIG. 4(*c*) to satisfy the following equation:

$$PdH \cdot SA - PdL(SA - SB) = F - f1 - f2 \quad (1)$$

The valve opening of the control valve CV is positioned between the middle open state of FIG. 4(*b*) and the full open state of FIG. 4(*c*). Thus, the discharge displacement of the compressor is varied between the minimum and the maximum.

For example, if the flow rate of the refrigerant in the refrigerant circuit is decreased because of a decrease in speed of the engine E, the downward force based on the pressure difference ΔPd between the two points decreases, and the electromagnetic force F, at this time, can not balance the forces acting on the rod 40. Therefore, the rod 40 moves upward, which compresses the first spring 50. The valve body 43 of the rod 40 is positioned such that the increase in the downward force f1 of the first spring 50 compensates for the decrease in the downward force between on the pressure difference ΔPd between the two points. As a result, the opening of the communication passage 47 is reduced and the crank pressure Pc is decreased. As a result, the difference between the crank pressure Pc and the pressure in the cylinder bores 1*a* is reduced, the inclination angle of the swash plate 12 is increased, and the discharge displacement of the compressor is increased. The increase in the discharge displacement of the compressor increases the flow rate of the refrigerant in the refrigerant circuit to increase the pressure difference ΔPd between the two points.

In contrast, when the flow rate of the refrigerant in the refrigerant circuit is increased because of an increase in speed of the engine E, the downward force based on the pressure difference ΔPd between the two points increases and the electromagnetic force F, at this time, can not balance the forces acting on the rod 40. Therefore, the rod 40 moves downward, which expands the first spring 50. The valve body 43 of the rod 40 is positioned such that the decrease in the downward force f1 of the first spring 50 compensates for the increase in the downward force based on the pressure difference ΔPd between the two points. As a result, the opening of the communication passage 47 is increased, the crank pressure Pc is increased, and the difference between the crank pressure Pc and the pressure in the cylinder bores 1*a* is increased. Accordingly, the inclination angle of the swash plate 12 is decreased, and the discharge displacement of the compressor is also decreased. The decrease in the discharge displacement of the compressor decreases the flow rate of the refrigerant in the refrigerant circuit, which decreases the pressure difference ΔPd between the two points.

When the duty ratio Dt of the electric current supplied to the coil 67 is increased to increase the electromagnetic force F, the pressure difference ΔPd between the two points can not balance the forces on the rod 40. Therefore, the rod 40 moves upward so that the first spring 50 is corresponded. The valve body 43 of the rod 40 is such that the increase in the downward force f1 of the first spring 50 compensates for the increase in the upward electromagnetic force F. As a result, the opening of the communication passage 47 is reduced and the discharge displacement of the compressor is increased. Accordingly, the flow rate of the refrigerant in the refrigerant circuit is increased to increase the pressure difference ΔPd between the two points.

In contrast, when the duty ratio Dt of the electric current supplied to the coil 67 is decreased, which decreases the electromagnetic force F, the pressure difference ΔPd between the two points at this time can not balance of the forces acting on the rod 40. Therefore, the rod 40 moves downward, which decreases the downward force f1 of the first spring 50. The valve body 43 of the rod 40 is positioned such that the decrease in the force f1 of the first spring 50 compensates for the decrease in the upward electromagnetic force F. As a result, the opening of the communication passage 47 is increased and the discharge displacement of the compressor is decreased. Accordingly, the flow rate of the refrigerant in the refrigerant circuit is decreased, which decreases the pressure difference ΔPd between the two points.

As described above, in the control valve CV, when an electric current that exceeds the minimum duty ratio Dt(min) is supplied to the coil 67, the rod 40 is positioned in accordance with the change in the pressure difference ΔPd between the two points to maintain a target value of the pressure difference ΔPd that is determined in accordance with the electromagnetic force F. By changing the electromagnetic force F, the target pressure difference can be varied between a minimum value, which corresponds to the minimum duty ratio Dt(min), and a maximum value, which corresponds to the maximum duty ratio Dt(max).

As shown in FIGS. 2 and 3, the vehicle air conditioner has a controller 70. The controller 70 is a computer control unit including a CPU, a ROM, a RAM, and an I/O interface. An external information detector 72 is connected to the input terminal of the I/O interface. A drive circuit 71 is connected to the output terminal of the I/O interface.

The controller 70 performs an arithmetic operation to determine a proper duty ratio Dt on the basis of various pieces of external information, which is detected by the external information detector 72, and instructs the drive circuit 71 to output a drive signal corresponding to the duty ratio Dt. The drive circuit 71 outputs the drive signal of the instructed duty ratio Dt to the coil 67. The electromagnetic force F by the solenoid 60 of the control valve CV varies in accordance with the duty ratio Dt of the drive signal supplied to the coil 67.

Sensors of the external information detector 72 include, e.g., an A/C switch (ON/OFF switch of the air conditioner operated by the passenger or the like) 73, a temperature sensor 74 for detecting an in-vehicle temperature Te(t), and a temperature setting unit 75 for setting a desired target value Te(set) of the in-vehicle temperature.

Figure 6:
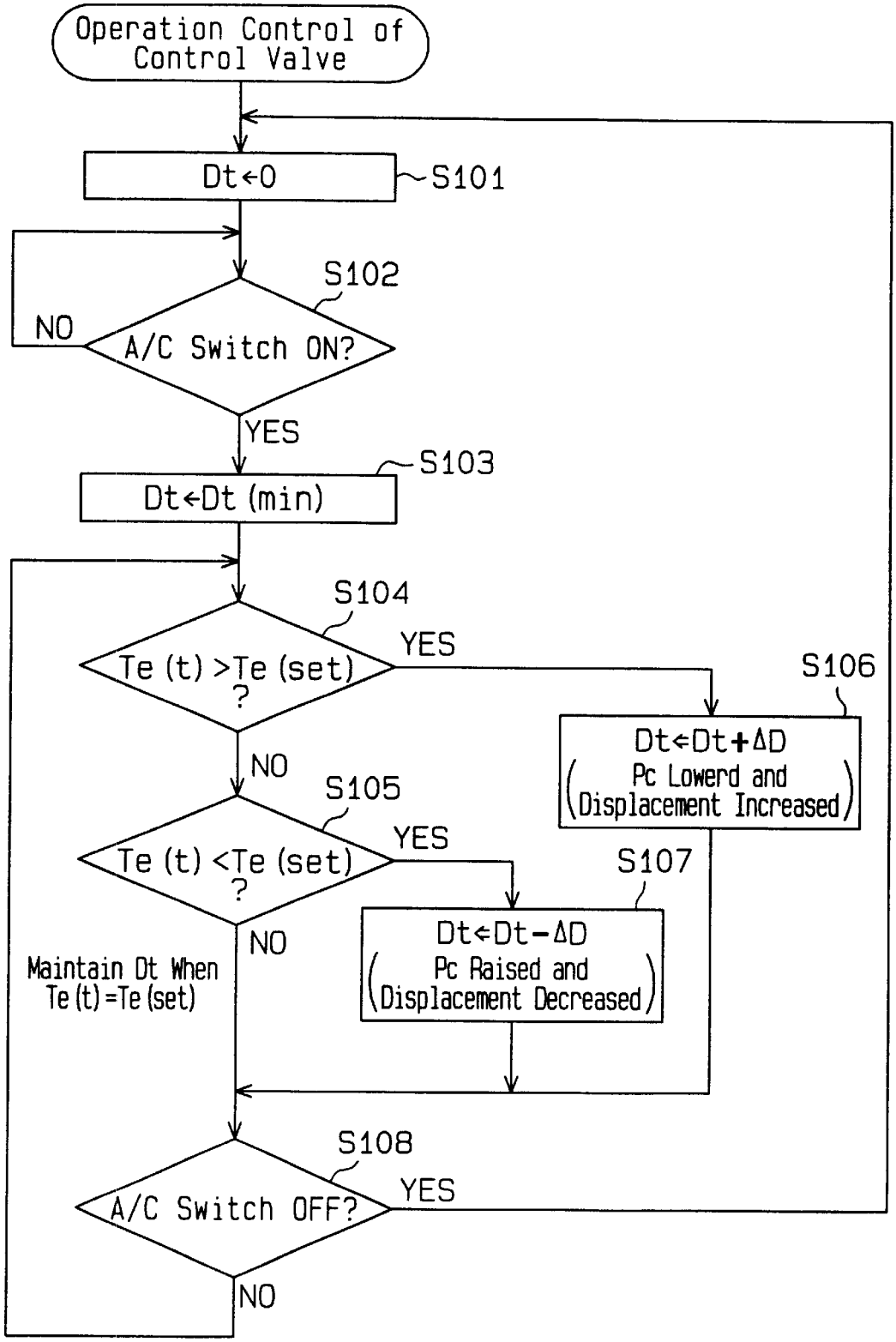
FIG. 6 is a flowchart of a control operation for the control valve.
Figure 7:
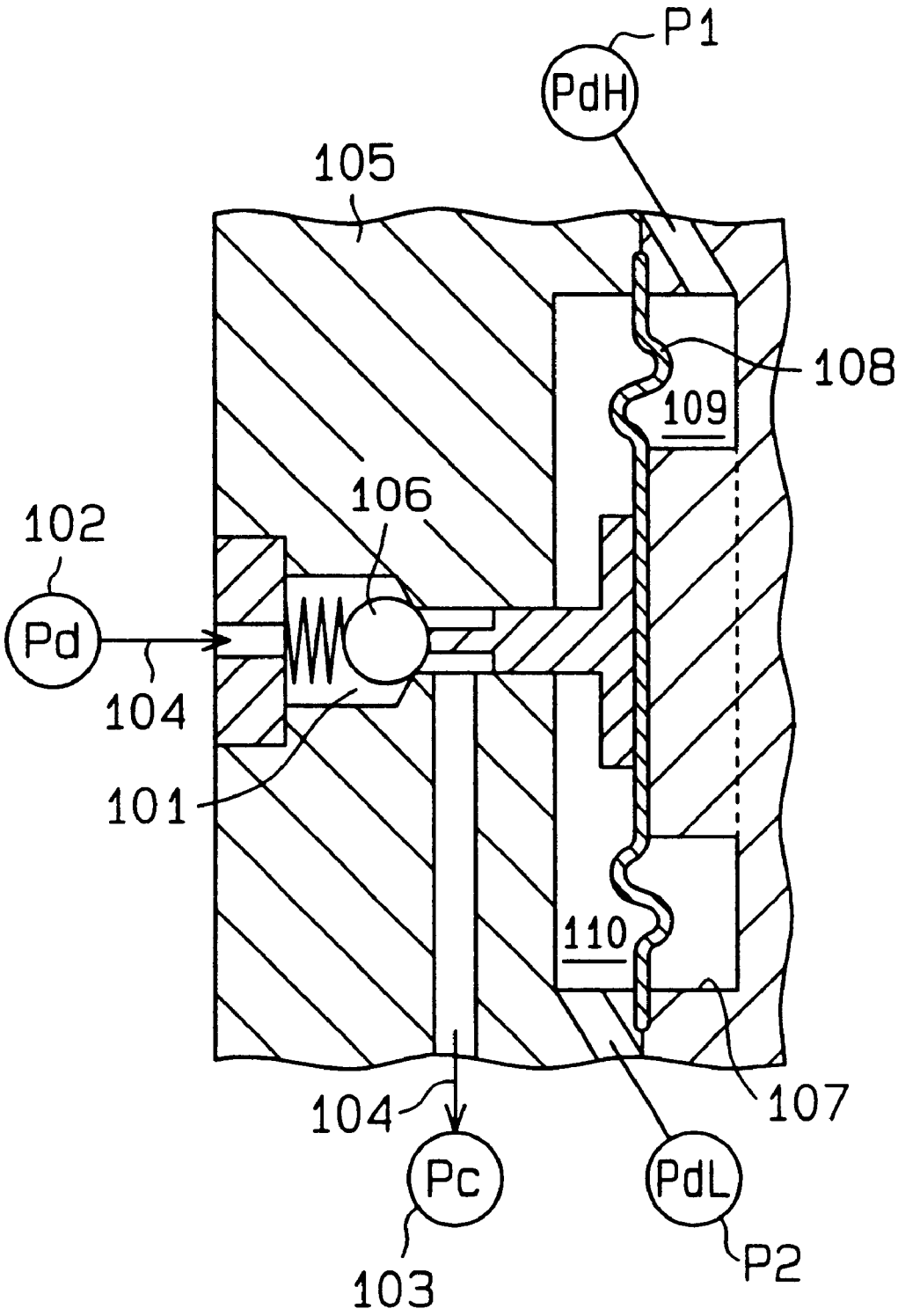
Fig.7 (Prior Art)
FIG. 7 is an enlarged partial cross-sectional view showing a prior art control valve.

Next, the duty control of the control valve CV by the controller 70 will be described with reference to the flowchart of FIG. 6.

When the ignition switch (or the start switch) of the vehicle is turned on, the controller 70 is supplied with an electric current to start processing. In step S101, the controller 70 makes various initializations. For example, the controller 70 sets an initial duty ratio Dt of zero. After this, condition monitoring and internal processing of the duty ratio Dt are performed.

In step S102, the controller 70 monitors the ON/OFF state of the A/C switch 73 until the switch 73 is turned on. When the A/C switch 73 is turned on, in step S103, the controller 70 sets the duty ratio Dt of the control valve CV to the minimum duty ratio Dt(min) and starts the internal self-control function (target pressure difference maintenance) of the control valve CV.

In step S104, the controller 70 judges whether the detected temperature Te(t) by the temperature sensor 74 is higher than the target temperature Te(set). If step S104 is negative, in step S105, the controller 70 further judges whether the detected temperature Te(t) is lower than the target temperature Te(set). When step S105 is negative, then the detected temperature Te(t) is equal to the target temperature Te(set). Therefore, the duty ratio Dt need not be changed. Thus, the controller 70 does not instruct the drive circuit 71 to change the duty ratio Dt and step S108 is performed.

If step S104 is positive, the interior of the vehicle is hot and the thermal load is high. Therefore, in step S106, the controller 70 increases the duty ratio Dt by a unit quantity ΔD and instructs the drive circuit 71 to increment the duty ratio Dt to a new value (Dt+ΔD). As a result, the valve opening of the control valve CV is somewhat reduced, the discharge displacement of the compressor is increased, the ability of the evaporator 33 to transfer heat is increased, and the temperature Te(t) is lowered.

If step S105 is positive, the interior of the vehicle is relatively cool and the thermal load is low. Therefore, in step S107, the controller 70 decrements the duty ratio Dt by a unit quantity ΔD, and instructs the drive circuit 71 to change the duty ratio Dt to the new value (Dt−ΔD). As a result, the valve opening of the control valve CV is somewhat increased, the discharge displacement of the compressor is decreased, the ability of the evaporator 33 to transfer heat is reduced, and the temperature Te(t) is raised.

In step S108, it is judged whether or not the A/C switch 73 is turned off. If step S108 is negative, step S104 is performed. When step S108 is positive, step S101, in which the supply of the current to the control valve CV is stopped, is performed. Therefore, the valve opening of the control valve CV is fully opened, beyond the middle position, to rapidly increase the pressure in the crank chamber 5. As a result, in response t the A/C switch 73 being turned off, the discharge displacement of the compressor can be rapidly minimized. This shortens the period during which refrigerant unnecessarily flows in the refrigerant circuit. That is, unnecessary cooling is minimized.

Particularly in a clutchless type compressor, the compressor is always driven when the engine E is operated. For this reason, when cooling is unnecessary (when the A/C switch 73 is in the off state), it is required that the discharge displacement be minimized to minimize the power loss of the engine E. To satisfy this requirement, the control valve CV is effective since its valve opening can be opened beyond the middle position to positively minimize the discharge displacement.

As described above, by changing the duty ratio Dt in step S106 and/or S107, even when the detected temperature Te(t) deviates from the target temperature Te(set), the duty ratio Dt is gradually optimized and the detected temperature Te(t) converges to the vicinity of the target temperature Te(set).

The above illustrated embodiment has the following advantages.

The spherical ball 54 is easily and accurately machined. Thus, the ball 54 costs less than diaphragm pressure sensing members. The ball 54 contacts the inner surface 48*a* of the pressure sensing chamber 48 to define the first and second pressure chambers 55, 56. Unlike a diaphragm, the ball 54 need not be fixed to the valve housing 45, which facilitates the installation of the ball 54. Further, since the ball 54 need not be set in a particular orientation, the installation is further facilitated. Accordingly, the cost of the control valve CV is reduced.

The ball 54 linearly contacts the inner surface 48*a* of the pressure sensing chamber 48, which minimizes the sliding resistance. Since the ball 54 has no orientation, the ball 54 is never inclined relative to the inner surface 48*a*. Therefore, when determining the position of the rod 40 (the valve body 43), hysteresis due to the sliding resistance is reduced. Thus, changes of the duty ratio DT and/or the pressure difference ΔPd are quickly reflected to the valve opening.

The first and second springs 50 and 66 and the first and second regulation surfaces 49 and 68 provide vibration resistance for the rod 40, the movable iron core 64, and the ball 54 when the coil 67 is not supplied with electric current. Therefore, the movable member 40, 54, or 64 will not collide with a fixed surface (e.g., the valve housing 45 or the like) due to vibration of the vehicle, and this prevents valve damage.

In this embodiment, to ensure the vibration resistance of the movable members 40, 54, and 64, the first and second springs 50 and 66 and the first and second regulation surfaces 49 and 68 are provided. In this embodiment, the movable members 40, 54 are separated when the coil 67 is not supplied with electric current.

In a control valve in which the rod 40 is formed integrally with the ball 54, which is referred to as the "comparative valve", if either the rod 40 or the ball 54 is abutted against a regulation surface by a spring, the other of the rod 40 and the ball 54 is indirectly pressed against the regulation surface. Therefore, only one spring and one regulation surface are provided.

As shown by a line made of long and short dashes in the graph of FIG. 5, however, a single spring in the comparative valve requires a heavy set load f' (f'=f1'+f2') that can press all the movable members 40, 54, and 64 against the regulation surface to vibration resistance. For the rod 40 to be fixed at an arbitrary position between the intermediate open state and the fully open state of the control valve CV, the spring of the comparative valve must have a large spring constant such that its characteristic line "f" slopes downward more than the characteristic line of the electromagnetic force F. More specifically, if the characteristic line "f" of the spring does not slope downward more than the characteristic line of the electromagnetic force F, the spring cannot compensate for changes in the electromagnetic force F, even when the rod 40 moves (in other words, even when the compression of the spring changes). This also applies to the first spring 50 of the illustrated embodiment. In the control valve having an integral rod and pressure sensing member, the force acting in the control valve is given by the following equation (2):

$$PdH \cdot SA - PdL(SA - SB) = F - f \quad (2)$$

When the duty ratio Dt exceeds the minimum duty ratio Dt(min), electromagnetic force F exceeds the initial load f', which moves the rod 40 upward. As the rod 40 moves upward, the force f of the springs 50, 66 is increased, accordingly. To move the rod 40 upward against the increasing force f to the intermediately open and to initiate the internal self-control comparative valve, the duty ratio Dt must be increased to the level Dt(1). In the range of the usable duty ratios Dt, the range to Dt(1) is used for starting the internal self-control function. As a result, the target pressure difference as a standard of the operation of the internal self-control function can by changed only by using a duty ratio Dt within a range from Dt(1) to Dt(max), which is narrower than the duty ratio of this embodiment. Thus the range of variation of the target pressure difference becomes narrower.

More specifically, in the comparative valve, only one spring is used for providing the vibration resistance of the movable members 40, 54 and for the internal self-control function based on the pressure difference ΔPd between the two points. Therefore, the force f applied to the rod 40 by the spring must be greater than the force f1+f2 of this embodiment. As a result, when the duty ratio Dt is maximized to Dt(max), the pressure difference ΔPd between the two points satisfying the equation (2) is small. This lowers the maximum target pressure difference, i.e., the controllable maximum flow rate in the refrigerant circuit.

In the comparative valve, assume that, to raise the maximum target pressure difference, the pressure sensing mechanism for the pressure difference ΔPd between the two points is modified to decrease the force applied to the rod 40 on the basis of the pressure difference ΔPd. For example, by reducing the cross sectional area SB of the distal end portion 41, the value of the left side of the equation (2) (PdH·SA−PdL(SA−SB)) is decreased. However, when the duty ratio Dt is at its minimum value Dt(1), the pressure difference ΔPd between the two points satisfying the equation (2) is large. This raises the minimum target pressure difference, i.e., the controllable minimum flow rate in the refrigerant circuit.

However, in the control valve CV of this embodiment, when the supply of electric current to the coil 67 is stopped, the movable members 40, 54 are separated, and the separated movable members 40, 54 are provided with the first and second urging springs 50 and 66 and the first and second regulation surfaces 49 and 68, respectively, for vibration resistance. The first spring 50 has a great spring constant that achieves the internal self-control function. The first spring 50 expands and contracts within the narrow range between the middle open state and the full open state (in other words, only within the range required for internal self-control function). On the other hand, the spring constant of the second spring 66, which must expand and contract within a wide range between the full open state and the closed state (in other words, within the range not required for the internal self-control function), is as low as possible.

As a result, while maintaining the vibration resistance of the movable members 40, 54, and 64, the force f1+f2 acting on the rod 40 is smaller than the force f of the comparative valve. Thus, using the duty ratio Dt within the wide range between Dt(min) and Dt(max), the target pressure difference can be changed in a wide range, i.e., the flow rate of the refrigerant in the refrigerant circuit can be controlled in a wide range.

Before valve body 43 contacts the ball 54, the ball 54 is pressed against the first regulation surface 49 by the first spring 50. That is, when there is no need for the position of the rod 40 to reflect the pressure difference ΔPd between the two points, the ball 54 is stationary. Thus, the ball 54 is never unnecessarily moved, unlike that of the comparative valve. Also, sliding between the ball 54 and the inner wall surface of the pressure sensing chamber 48 is reduced. This improves the durability of the ball 54 and the durability of the control valve CV.

In general, the compressor of the vehicle air conditioner is located in the narrow engine room of a vehicle. For this reason, the size of the compressor is limited. Therefore, the size of the control valve CV and the size of the solenoid 60 (the coil 67) are limited accordingly. Also, in general, the engine battery powers the solenoid 60 is used. The voltage of the vehicle battery is regulated to, e.g., 12 to 24 V.

In the comparative valve, when the maximum electromagnetic force F that the solenoid 60 is capable of generating is intended to be increased to widen the range of variation of the target pressure difference, increasing in size of the coil 67 and raising the voltage of the power supply are impossible, because either would entail considerable changes in existing systems and structures. In other words, if the control valve CV of the compressor uses an electromagnetic actuator as an external control device, this embodiment is most suitable for widening the range of variation of the target pressure difference.

When the ball 54 contacts the first regulation surface 49 and the distal end portion 41 is separated from the ball 54, the space 59 is defined by the bottom of the ball 54 and the distal end portion 41. The space 59 communicates with the second pressure chamber 56 through the releasing groove 54*b*. Thus, refrigerant gas remaining in the space 59 does not affect the positioning of the valve body 43. This allows the desired valve opening control.

When the ball 54 contacts the first regulation surface 49 and the distal end portion 41 is separated from the ball 54, the space 59 is defined by the bottom of the ball 54 and the distal end portion 41. The space 59 communicates with the second pressure chamber 56 through the releasing groove 56*b*. Thus, refrigerant gas remaining in the space 59 does not affect the positioning of the valve body 43. This allows the desired valve opening control.

If the control valve CV does not the releasing groove 56*b*, the space 59 is closed when the ball 54 contacts the first regulation surface 49. In this case, when the ball 54 contacts the first regulation surface 49 and the rod 40 separates from the ball 54, the refrigerant gas in the space 59 expands due to an increase in volume of the space 59. This expansion delays the movement of the rod 40 upward. As a result, contact of the rod 40 with the second regulation surface 68, i.e., full opening of the communication passage 47 by the valve body 43 is delayed.

Also, when the rod 40 contacts the ball 54, the refrigerant gas in the space 59 is compressed due to the decrease in volume of the space 59. This compression delays movement of the rod 40. As a result, contact between the rod 40 and the ball 54 is delayed, and the start of the internal self-control function is delayed.

Particularly, at the e time the internal self-control function is started, the moment connected between the space 59 and the second pressure chamber 56, the pressure in the second pressure chamber 56 increases such that the gas in the space 59 that is at a high pressure since the above-described compression. Therefore, the pressure difference ΔPd which acts on the ball 54 becomes small. As a result, the rod 40 moves upward more than required, and the valve body 43 reduces the size of the opening of the communication passage 47 more than required. This makes the discharge displacement of the compressor too high.

When the ball 54 contacts the first regulation surface 49, the groove 56*b* communicates the space 59 with the second a pressure chamber 56. Two-dashed line in FIG. 4(*a*) shows a another structure for communicating the space 59 with the second pressure chamber 56 when the ball 54 contacts the first regulation surface 49. In this structure, the groove 56*b* is replaced by a passage. This passage communicates the space 59 to a part of the bottom 56*a* that is separated from the contact portion between the ball 54 and the first regulation surface 49. Compared to the structure of two-dashed line, the groove 56*b* is simple.

Instead of the groove 56*b*, a groove may be formed on the ball 54. However, since the orientation of the ball 54 is not fixed, part that contacts the first regulation surface 49 cannot be predicted. Therefore, if a groove is formed on the ball 54, the ball 54 must not rotate, which complicates the structure and the advantages of the spherical shape are reduced.

However, in the illustrated embodiment, the groove 56*b* is formed in the first regulation surface 49. Therefore, the illustrated embodiment make s the most use of the spherical shape o f the ball 54 are utilized guaranteed.

The first spring 50 urges the ball 54 toward the second pressure chamber 56. That is, the direction in which the first spring 50 urges the ball 54 is the same as the direction in which a pressing force based on the pressure difference ΔPd between the two points acts. Therefore, when the current is not supplied the coil 67, the ball 54 is pressed against the first regulation surface 49 with a force based on of the spring 50 and the pressure difference ΔPd between the two points.

The control valve CV changes the pressure in the crank chamber 5 by so-called inlet valve control, in which the opening of the supply passage 28 is changed. Therefore, in comparison with outlet valve control, in which the opening of the bleed passage 27 is changed, the pressure in the crank chamber 5, i.e., the discharge displacement of the compressor, can be changed more rapidly.

The first and second pressure monitoring points P1 and P2 are located in the refrigerant circuit between the discharge chamber 22 of the compressor and the condenser 31. Therefore, the operation of the expansion valve 32 does not affect the detection of the discharge displacement of the compressor based on the pressure difference ΔPd between the two points.

It should be apparent to those skilled in the art that the present invention may be embodied in many other specific forms without departing from the spirit or scope of the invention. Particularly, it should be understood that the invention may be embodied in the following forms.

A groove for communicating the space 59 with the second pressure chamber 56 when the ball 54 contacts the first regulation surface 49 may be formed on the ball 54. In this case, the groove 56*b* may remain.

The groove 56*b* may be omitted. In this case, when contacting the first regulation surface 49, the ball 54 disconnects the space 59 from the second pressure chamber 56. As shown by two-dashed line in FIG. 4(*a*), a passage 80 may be formed to communicate the space 59 with the second pressure chamber 56, which is exposed to the pressure PdL. Alternatively, the space 59 may be directly communicated with the second port 58. Also, the space 59 may be directly communicated with the second pressure introduction passage 38. Further, the space 59 may be directly communicated with the second pressure monitoring point P2.

The first pressure monitoring point P1 may be provided in the suction pressure zone between the evaporator 33 and the suction chamber 21, and the second pressure monitoring point P2 may be provided downstream of the first pressure monitoring point P1.

The first pressure monitoring point P1 may be provided in the discharge pressure zone between the discharge chamber 22 and the condenser 31, and the second pressure monitoring point P2 may be provided in the suction pressure zone between the evaporator 33 and the suction chamber 21.

The first pressure monitoring point P1 may be provided in the discharge pressure zone between the discharge chamber 22 and the condenser 31, and the second pressure monitoring point P2 may be provided in the crank chamber 5. Otherwise, the first pressure monitoring point P1 may be provided in the crank chamber 5, and the second pressure monitoring point P2 may be provided in the suction pressure zone between the evaporator 33 and the suction chamber 21. The locations of the pressure monitoring points P1 and P2 are not limited to the main circuit of the cooling circuit, i.e., the evaporator 33, the suction chamber 21, the cylinder bores la, the discharge chamber 22, or the condenser 31. That is, the pressure monitoring points P1 and P2 need not be in a high pressure region or a low pressure region of the refrigerant circuit. For example, the pressure monitoring points P1 and P2 may be located in a refrigerant passage for displacement control that is a subcircuit of the cooling circuit, i.e., a passage formed by the crank chamber 5 in a middle pressure zone of the supply passage 28, the crank chamber 5, and the bleed passage 27.

The control valve may be a so-called outlet control valve for controlling the crank pressure Pc by controlling the opening of the bleed passage 27.

When the electromagnetic force F is increased, the valve opening size of the control valve CV may be increased and the target pressure difference may be decreased.

In the illustrated embodiment, the second spring 66 is accommodated in the solenoid chamber 63. However, the second spring 66 may be accommodated in the valve chamber 46.

The solenoid portion 60 may be omitted so that the control valve CV maintains a constant target pressure difference.

The present invention can be embodied in a control valve of a wobble type variable displacement compressor.

There are compressors that minimize the displacement to reduce the power loss of the connected vehicle engine when the vehicle is suddenly accelerated. To effectively reduce the power loss, the displacement need be minimized quickly. The control valve CV of the illustrated embodiment is suitable for such compressors since the opening size of the control valve CV can be greater than the intermediately open state, at which the displacement is minimum.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor in a refrigerant circuit, wherein the compressor changes the displacement in accordance with the pressure in a crank chamber and includes a supply passage, which connects a discharge pressure zone to the crank chamber, and a bleed passage, which connects a suction pressure zone to the crank chamber, the control valve comprising:

a valve housing;

a valve chamber defined in the valve housing, wherein the valve chamber is part of the supply passage or the bleed passage;

a valve body located in the valve chamber, wherein the valve body changes its position in the valve chamber thereby adjusting the opening size of the supply passage or the bleed passage in the valve chamber;

a pressure sensing chamber defined in the valve housing;

a spherical pressure sensing member, wherein the pressure sensing member is movably located in the pressure sensing chamber and divides the pressure sensing chamber into a first pressure chamber and a second pressure chamber; and first and second pressure monitoring points located in the refrigerant circuit, wherein the first pressure chamber is exposed to the pressure at the first pressure monitoring point, and the second pressure chamber is exposed to the pressure at the second pressure monitoring point, wherein the pressure sensing member moves in accordance with the pressure difference between the first pressure chamber and the second pressure chamber, and wherein the position of the valve body is determined based on the position of the pressure sensing member.

2. The control valve according to claim 1, further comprising an external controller, wherein the controller changes a target pressure difference, and wherein the target pressure difference is a referential value used when the position of the valve body is determined by the pressure sensing member.

3. The control valve according to claim 2, further comprising:

a first regulator located in the valve housing, wherein the first regulator regulates the movement of the pressure sensing member;

a first urging member for urging the pressure sensing member toward the first regulator;

a second regulator located in the valve housing, wherein the second regulator regulates the movement of the valve body;

a second urging member for urging the valve body toward the second regulator;

wherein the valve body contacts and separates from the pressure sensing member;

wherein, when the valve body separates from the pressure sensing member, the movement of the valve body is regulated by the second regulator and the movement of the pressure sensing member is regulated by the first regulator; and wherein the controller applies a force to the valve body against the force of the first urging member and against the force of the second urging member thereby causing the valve body to contact the pressure sensing member, and wherein the controller changes the magnitude of the force to change the target pressure difference.

4. The control valve according to claim 3, wherein the first urging member is a spring and the second urging member is a spring, and wherein the spring constant of the second urging member is smaller than that of the first urging member.

5. The control valve according to claim 3, wherein the first regulator is located in the second pressure chamber and in the vicinity of the valve chamber, wherein the movement of the pressure sensing member is regulated by the first regulator, the control valve further comprising communication means, wherein, when the valve body separates from the pressure sensing member and a space is created between the pressure sensing member and the valve body, the communication means communicates the space with the second pressure chamber.

6. The control valve according to claim 5, wherein the communication means is a groove formed in the valve housing.

7. The control valve according to claim 4, wherein the second urging member applies a constant force to the valve body regardless of the position of the valve body.

8. The control valve according to claim 3, wherein the first urging member urges the pressure sensing member from the first pressure chamber toward the second pressure chamber.

9. The control valve according to claim 1, wherein the valve chamber is part of the supply passage.

10. The control valve according to claim 1, wherein the refrigerant circuit includes a condenser, and wherein the first and second pressure monitoring points are located between the discharge pressure zone of the compressor and the condenser.

11. The control valve according to claim 2, wherein the external controller includes an electromagnetic actuator, and wherein the electromagnetic actuator changes the force applied to the valve body.

12. The control valve according to claim 1, wherein the second regulator regulates the movement of the valve body thereby preventing the displacement of the compressor from being decreased below a predetermined level.

13. The control valve according to claim 1, wherein the refrigerant circuit is used in a vehicle air conditioner.

14. The control valve according to claim 13, wherein the compressor is coupled to and driven by a vehicle engine through a clutchless type power transmission mechanism.

15. A variable displacement compressor in a refrigerant circuit, wherein the compressor changes the displacement in accordance with the pressure in a crank chamber and includes a supply passage, which connects a discharge pressure zone to the crank chamber, and a bleed passage, which connects a suction pressure zone to the crank chamber, and a control valve, which is connected to the supply passage or to the bleed passage, wherein the control valve comprises:

a valve housing;

a valve chamber defined in the valve housing, wherein the valve chamber is part of the supply passage or the bleed passage;

a valve body located in the valve chamber, wherein the valve body changes its position in the valve chamber thereby adjusting the opening size of the supply passage or the bleed passage in the valve chamber;

a pressure sensing chamber defined in the valve housing;

a spherical pressure sensing member, wherein the pressure sensing member is movably located in the pressure sensing chamber and divides the pressure sensing chamber into a first pressure chamber and a second pressure chamber; and first and second pressure monitoring points located in the refrigerant circuit, wherein the first pressure chamber is exposed to the pressure at the first pressure monitoring point, and the second pressure chamber is exposed to the pressure at the second pressure monitoring point, wherein the pressure sensing member moves in accordance with the pressure difference between the first pressure chamber and the second pressure chamber, and wherein the position of the valve body is determined based on the position of the pressure sensing member.

16. The compressor according to claim 15, further comprising an external controller, wherein the controller changes a target pressure difference, and wherein the target pressure difference is a referential value used when the position of the valve body is determined by the pressure sensing member.

17. The compressor according to claim 16, wherein the control valve comprises:

a first regulator located in the valve housing, wherein the first regulator regulates the movement of the pressure sensing member;

a first urging member for urging the pressure sensing member toward the first regulator;

a second regulator located in the valve housing, wherein the second regulator regulates the movement of the valve body;

a second urging member for urging the valve body toward the second regulator;

wherein the valve body contacts and separates from the pressure sensing member;

wherein, when the valve body separates from the pressure sensing member, the movement of the valve body is regulated by the second regulator and the movement of the pressure sensing member is regulated by the first regulator; and wherein the controller applies a force to the valve body against the force of the first urging member and against the force of the second urging member thereby causing the valve body to contact the pressure sensing member, and wherein the controller changes the magnitude of the force to change the target pressure difference.

18. The compressor according to claim 17, wherein the first urging member is a spring and the second urging member is a spring, and wherein the spring constant of the second urging member is smaller than that of the first urging member.

19. The compressor according to claim 17, wherein the first regulator is located in the second pressure chamber and in the vicinity of the valve chamber, wherein the movement of the pressure sensing member is regulated by the first regulator, the compressor further comprising communication means, wherein, when the valve body separates from the pressure sensing member and a space is created between the pressure sensing member and the valve body, the communication means communicates the space with the second pressure chamber.

20. The compressor according to claim 19, wherein the communication means is a groove formed in the valve housing.

* * * * *